US006018827A

United States Patent [19]

Shaw et al.

[11] Patent Number: 6,018,827

[45] Date of Patent: Feb. 1, 2000

[54] PUSH BUTTON ASSEMBLY FOR CONTROL OF PLUMBING FIXTURES IN PRISONS AND THE LIKE

[75] Inventors: Daniel C. Shaw, Geneva; Donald F. Bush, Orlando, both of Fla.

[73] Assignee: Sloan Valve Company, Franklin Park, Ill.

[21] Appl. No.: 08/089,595

[22] Filed: Jul. 12, 1993

Related U.S. Application Data

[63] Continuation of application No. 07/822,201, Jan. 17, 1992, abandoned, which is a continuation-in-part of application No. 07/800,718, Dec. 3, 1991, abandoned, which is a continuation of application No. 07/607,275, Oct. 31, 1990, abandoned, which is a division of application No. 07/382,113, Jul. 20, 1989, Pat. No. 4,985,944.

[51] Int. Cl.[7] ..... E03D 5/10

[52] U.S. Cl. ..... 4/664; 4/406

[58] Field of Search ..... 200/61.7, 61.76, 200/61.78, 296, 345, 237, 238, 341, 502, 520; 4/664, 406, 410, DIG. 3, DIG. 15

[56] References Cited

U.S. PATENT DOCUMENTS

| | | | |
|---|---|---|---|
| 3,249,727 | 5/1966 | Furman | 200/61.7 X |
| 4,123,640 | 10/1978 | Ballantyne | 200/296 |
| 4,195,374 | 4/1980 | Morris et al. | 4/427 |
| 4,480,163 | 10/1984 | Morris et al. | 200/345 X |
| 4,982,058 | 1/1991 | Schroeder et al. | 200/61.76 X |

*Primary Examiner*—Robert M. Fetsuga

*Attorney, Agent, or Firm*—Liniak, Berenato, Longarce & White, LLC

[57] ABSTRACT

A controlled plumbing fixture comprises a plumbing fixture, an electromechanical valve operably associated with the fixture for regulating water flow thereto, a control operably associated with the valve for controlling operation thereof, and a push button assembly cooperating with the control. The push button has an axially movable plunger, an axially movable signal supplying element, and an elastomeric member disposed about and slidably engaged with the signal supplying element for selectively positioning and maintaining the signal supplying element intermediate axially spaced first and second points. The push button is operably associated with the control for causing a demand signal to be supplied to the control for thereby causing the control to supply a control signal to the valve, so that operation thereof occurs upon actuation of said signal supplying element by movement of the plunger.

8 Claims, 5 Drawing Sheets

PUSH BUTTON ASSEMBLY FOR CONTROL OF PLUMBING FIXTURES IN PRISONS AND THE LIKE

CROSS REFERENCE TO RELATED APPLICATIONS

This is a continuation of application Ser. No. 07/822,201, filed on Jan. 17, 1992, abandoned which is a continuation-in-part of application Ser. No. 07/800,718, filed Dec. 3, 1991, of Daniel C. Shaw for PLUMBING CONTROL SYSTEM AND METHOD FOR PRISONS, abandoned which is a continuation of application Ser. No. 07/607,275, filed Oct. 31, 1990, abandoned, and which is a division of application Ser. No. 07/382,113, filed Jul. 20, 1989, now U.S. Pat. No. 4,985,944.

FIELD OF THE INVENTION

The present invention is directed to a system and method for controlling the operation of plumbing fixtures in prisons and like facilities. More particularly, the invention is directed to means for delaying operation of a plumbing fixture in order to prevent articles from being flushed down the drain. In addition, a novel self-calibrating push button is disclosed.

BACKGROUND OF THE INVENTION

Many penal institutions, such as prisons, jails and the like, experience inmate-caused plumbing disruptions. These disruptions may be localized, such as when an inmate breaks a particular plumbing fixture, and they also may be systematic. Systematic disruptions occur when the plumbing system for the entire facility is interrupted, such as by the drain or sewer being stopped. Not only are such disruptions expensive to repair, but they also present a sanitation problem.

Corrections officers working in a penal institution will sometimes conduct a search for contraband possessed by the inmates. Should the inmates learn of such an inspection, then it is common for the contraband to be flushed down the toilet. In that event, the corrections officers have no way of identifying which inmates possess the contraband or even that contraband was present, thereby preventing the appropriate corrective action from being taken.

Those skilled in the art appreciate that the cost of incarcerating inmates has been increasing at a substantial rate over the past several years. These cost increases have been due, to some extent, upon the need to build additional facilities, and also to the cost of maintaining existing facilities. Anything which will reduce the cost of building and/or operating a penal institution will be helpful.

The disclosed invention is a system and method for controlling the operation of water-consuming fixtures in a prison. Each fixture is caused to be operated by an inmate-operated actuator which transmits an electrical demand signal to a remotely located central controller. The controller identifies the fixture requesting operation, determines whether the fixture is being abused through repeated operation, and generates a control signal which causes the fixture to be operated only after a predetermined delay. Means are also provided in the control system for preventing operation of all fixtures, for notifying corrections officers of potential vandalism at a fixture, and also for preventing excess water from flowing to sinks and the like. Means are also provided for preventing excessive simultaneous operation of a selected number of fixtures, thereby making maximum usage of the available water supply.

OBJECTS AND SUMMARY OF THE INVENTION

The primary object of the disclosed invention is a plumbing control system for a prison which delays operation of a water-consuming fixture for a period of time sufficient to prevent sheets and the like from being flushed down the drain, and which also prevents excessive use of the fixtures.

An additional object of the disclosed invention is a method which prevents excessive usage of a water-consuming fixture, and which also delays operation for a predetermined period sufficient to prevent sheets and the like from being flushed.

A flushing control system for prisons and the like comprises a fixture and a source of water. Means are interposed between the fixture and the source for regulating the flow of water to the fixture. Means are operably associated with the fixture for requesting operation of the regulating means, and control means are operably associated with the regulating means and with the requesting means for causing operation of the regulating means to be delayed for a selected period after the requesting means has been operated and for limiting the number of operations of the regulating means per unit time.

A control system for a prison plumbing system comprises a plurality of spaced fixtures and a source of water. A first plurality of flow regulating means are provided, and each of the flow regulating means is interposed between one of the fixtures and the source. A first plurality of detectors are provided, and each detector is positioned proximate one of the fixtures and is actuatable to request operation of the associated fixture. Control means are operably associated with each of the flow regulating means and with the detectors for causing operation of a flow regulating means upon the expiration of at least a predetermined period subsequent to actuation of the associated detector, and for limiting the number of operations of each flow regulating means per unit time.

The method of controlling operation prison fixtures and the like comprises the steps of signaling to a control means a request for operation of a prison fixture. Operation of the fixture is prevented if the operation thereof would exceed a predetermined number of operations per unit time, and operation of the fixture is delayed for a predetermined period if operation thereof would not exceed the predetermined number of operations per unit time. The fixture is operated after the predetermined period has expired.

A controlled plumbing fixture comprises a plumbing fixture and an operably associated electromechanical valve means for regulating the flow of water to the fixture. A control means is operably associated with the valve means for controlling operation thereof. A self-calibrating push button is operably associated with the control means for supplying a demand signal thereto, and for thereby causing the control means to supply a control signal to the valve means for causing operation thereof.

A controlled plumbing fixture comprises a plumbing fixture and an electromechanically operated valve operably associated with the fixture for regulating the flow of water to the fixture. A push button plunger is operably associated with the fixture for being operated by a user. Biasing means are operably associated with the plunger for urging the plunger in a first direction toward the user. Movable sensor means are spaced from the plunger for generating a demand signal upon a user moving the plunger into operative association with the sensor means. Control means are operably associated with the sensor means and the valve for causing the valve to operate when the control means receives a demand signal and then for generating a control signal for the valve.

A self-calibrating push button comprises a housing having a central chamber and first and second spaced openings therein. A plunger is positioned and movable within the chamber, and has a portion extending through one of the openings. Biasing means are operably associated with the plunger for urging the plunger toward the one opening. Sensor means are operably associated with the housing, and has a portion extending through the other one of the openings and into the chamber toward the plunger. Means are operably associated with the sensor means for permitting the sensor means to move in response to movement of the plunger toward the other one opening, and for maintaining the sensor means thereafter at the position to which it was moved through movement of the plunger.

A method of calibrating a push button having a plunger, a spring operably associated with the plunger for urging the plunger in a first direction, and a sensor, includes the steps of moving the plunger in a second direction opposite to the first direction and thereby engaging the sensor and moving the sensor in the second direction and slidably securing the sensor at the position to which it was moved by the plunger.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DETAILED DESCRIPTION OF THE INVENTION

Figures 1, 4:
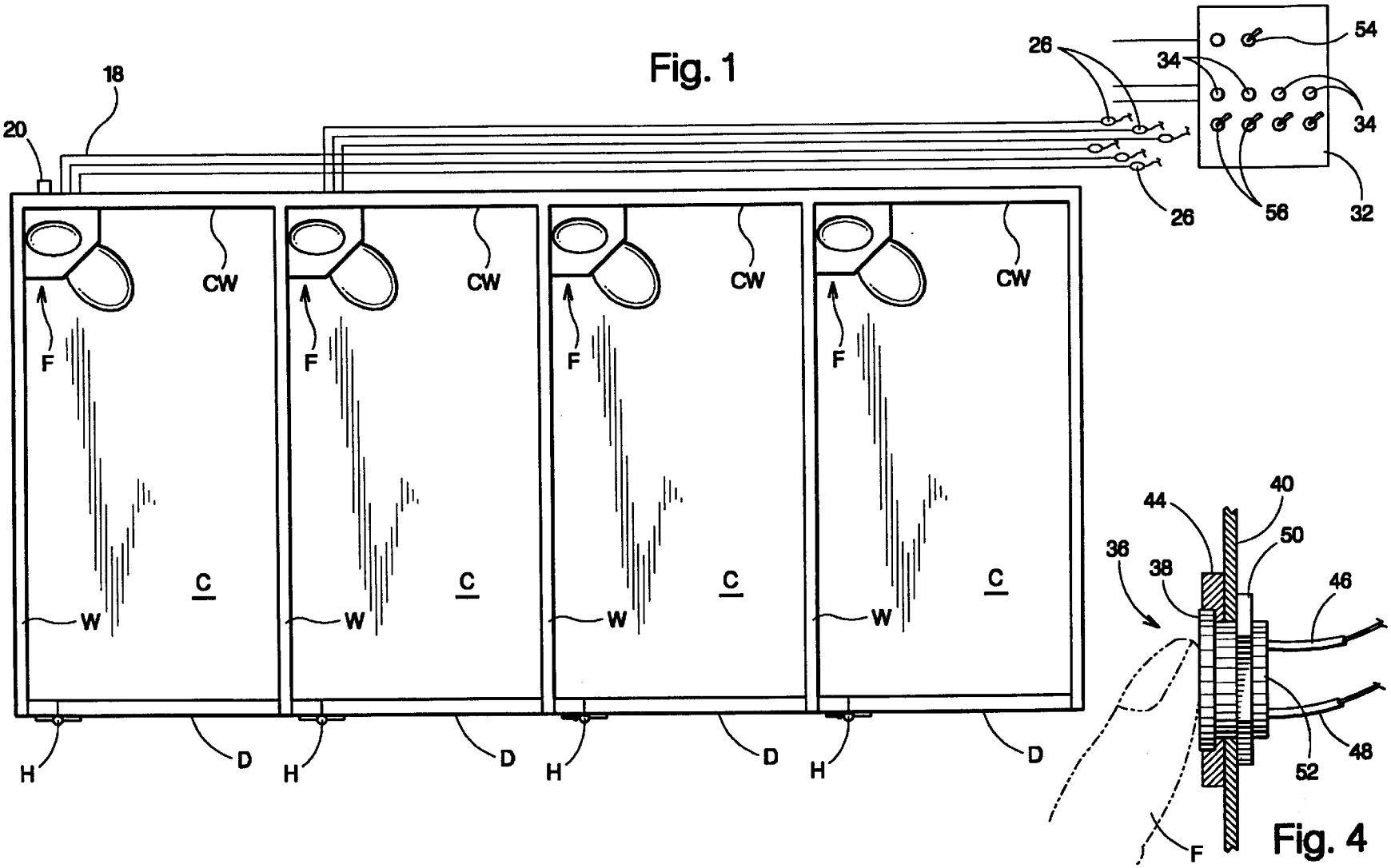
FIG. 1 is a fragmentary top plan view, partially in schematic, illustrating a prison wing incorporating the control system of the invention.
FIG. 4 is a fragmentary elevational view, partially in section, disclosing a capacitance sensor for the invention.

FIG. 1 discloses a plurality of spaced jail cells C, with each cell C having a door D closing one end thereof and being pivotal about hinge assembly H. Chase wall CW closes the end of each cell C opposite to door D, and walls W separate the cells from each other. While four cells C are disclosed in FIG. 1, those skilled in the art will appreciate that a greater or fewer number may be provided, depending upon the particular penal institution.

Figure 3:
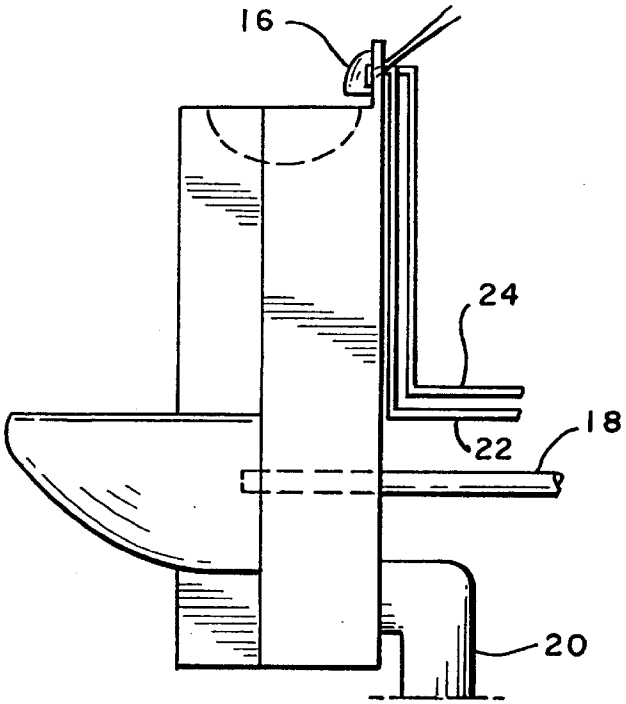
FIG. 3 is a side elevational view of the fixture of FIG. 2.
Figure 2:
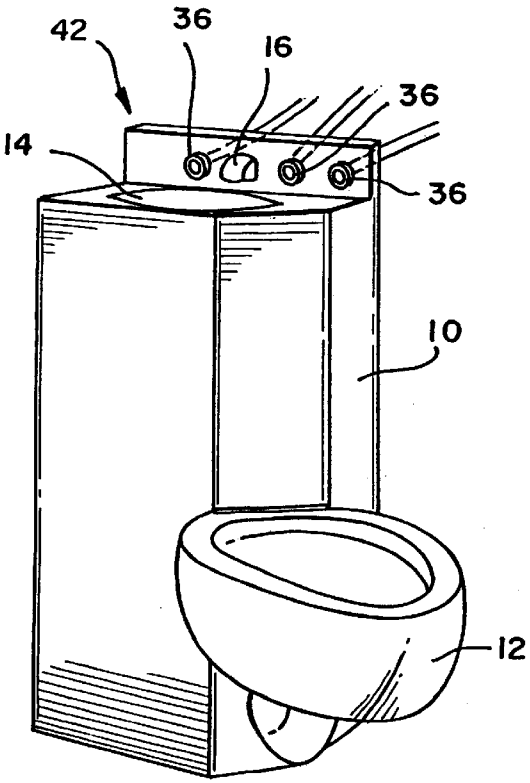
FIG. 2 is a perspective view of a prison fixture according to the invention.

Each cell C, as best shown in FIG. 1, has a water-consuming fixture F in one corner thereof. The fixtures F, as best shown in FIGS. 2 and 3, each include a cabinet 10 to which a toilet 12 is attached. The cabinet 10 also includes an integral sink 14 with a faucet 16. The fixture F is, preferably, comprised of stainless steel and may be located anywhere within the associated cell C. Naturally, as those skilled in the art will appreciate, other types of fixtures, such as showers and the like, may be used with the invention.

Toilet 12, as best shown in FIG. 3, has a flushing water supply line 18 and a drain line 20. The toilet is conventional in design, and causes waste to be removed from the bowl to a treatment plant.

Cold water line 22 and hot water line 24 each feed faucet 16 issuing into sink 14. Preferably, a T-fitting of conventional type provides a mixing chamber for the hot and cold water lines 22 and 24, prior to feeding the faucet 16. In this way, the temperature of the water filling the sink 14 may be regulated. Also, while not illustrated, it will be understood by those skilled in the art that a drain leads from the sink 14 to a sewer as is conventional.

Figure 5:
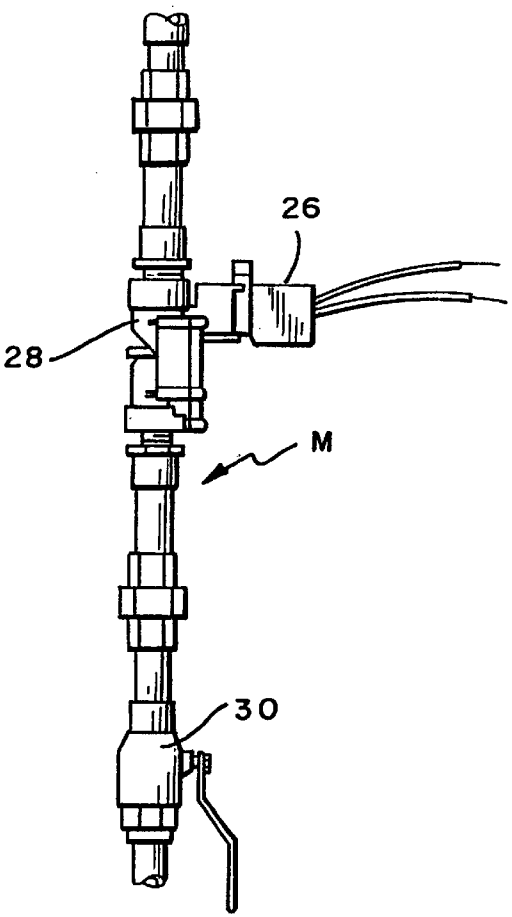
FIG. 5 is a fragmentary side elevational view of the flow regulating manifold of the invention.

FIG. 5 discloses water supply manifold M having electrically operated solenoid valve operator 26 controlling flow regulating valve 28. The valve 28 is, preferably, a normally closed valve, so that failure of the electric current to the valve operator 26 will prevent water from issuing through the valve 28. An acceptable solenoid operated valve is manufactured by James Hardie Industries Group as model #700–1.0. A manual shut-off valve 30 is downstream of flow valve 28, in order to permit the valve 28 to be changed or serviced as necessary. Naturally, appropriate plumbing interconnects the valve 30 with the valve 28, and also leads from the valve 28 to the toilet 12 or the faucet 16.

Inmates have a tendency to vandalize or destroy anything placed within their respective cell C. This includes, for example, any exposed plumbing or the like. For this reason, we position the solenoid valve operator 26 and control valve 28 at a location remote from the fixture F, preferably in a maintenance room, in order to minimize damage. Also, because of the control valve 28, we can utilize a relatively small water line, or even tubing. We provide a manifold M, comprising a solenoid operator 26 and flow valve 28, for each of the lines 18, 22 and 24 for each of the fixtures F. In this way, water can be selectively supplied to the lines 18, 22 and 24 of each cell C, while water flow to any or all of the other cells C is prevented.

The solenoid operators 26 are, as those skilled in the art will appreciate, electrically operated in response to a control signal. The valve 28 is normally closed, with the result that the control signal is used to open the valve. We provide a control panel 32, as best shown in FIG. 1, which is remote from the cells C. Preferably, control panel 32 is relatively close to, and may be in, the same maintenance room as the control valves 28 and operators 26. This minimizes difficulties in wiring the control panel 32 to the operators 26, and also facilities subsequent servicing. The control panel 32 has a plurality of indicator lamps 34, for reasons to be explained.

We provide capacitance sensors 36 on the fixture F for requesting operation of the various control valves 28, although push buttons may be used. Also, because only a demand signal needs to be transmitted to the control panel 32, a capacitance sensor can provide that signal. A capacitance sensor is one which consists of two conductors, such as parallel stainless steel plates, which are insulated from each other by a dielectric, for introducing capacitance into a circuit. This causes the electrical energy to be stored, blocks the flow of direct current, and permits the flow of alternating current to a degree dependent upon the capacitor's capacitance and the current frequency. Therefore, it is only necessary for the inmate to touch an exposed metal plate for the capacitance to be altered, and this causes a demand signal to be transmitted to the control panel 32.

Each of the capacitance sensors 36, as best shown in FIG. 4, comprises an outer stainless steel plate 38 which is isolated by dielectric 44 from the stainless steel plate 40 integral with the splash guard 42 of fixture F. Leads 46 and 48 run from each sensor 36 to the control panel 32, in order to transmit the demand signal thereto. Preferably, a lock washer 50 secures the longitudinally extending threaded plastic member 52 to the plate 40 for maintaining proper positioning of the plate 38. As a result, it is merely necessary that a finger G of an inmate (not shown) touch the plate 38, in order for a demand signal to be transmitted to the control panel 32.

Figure 6:
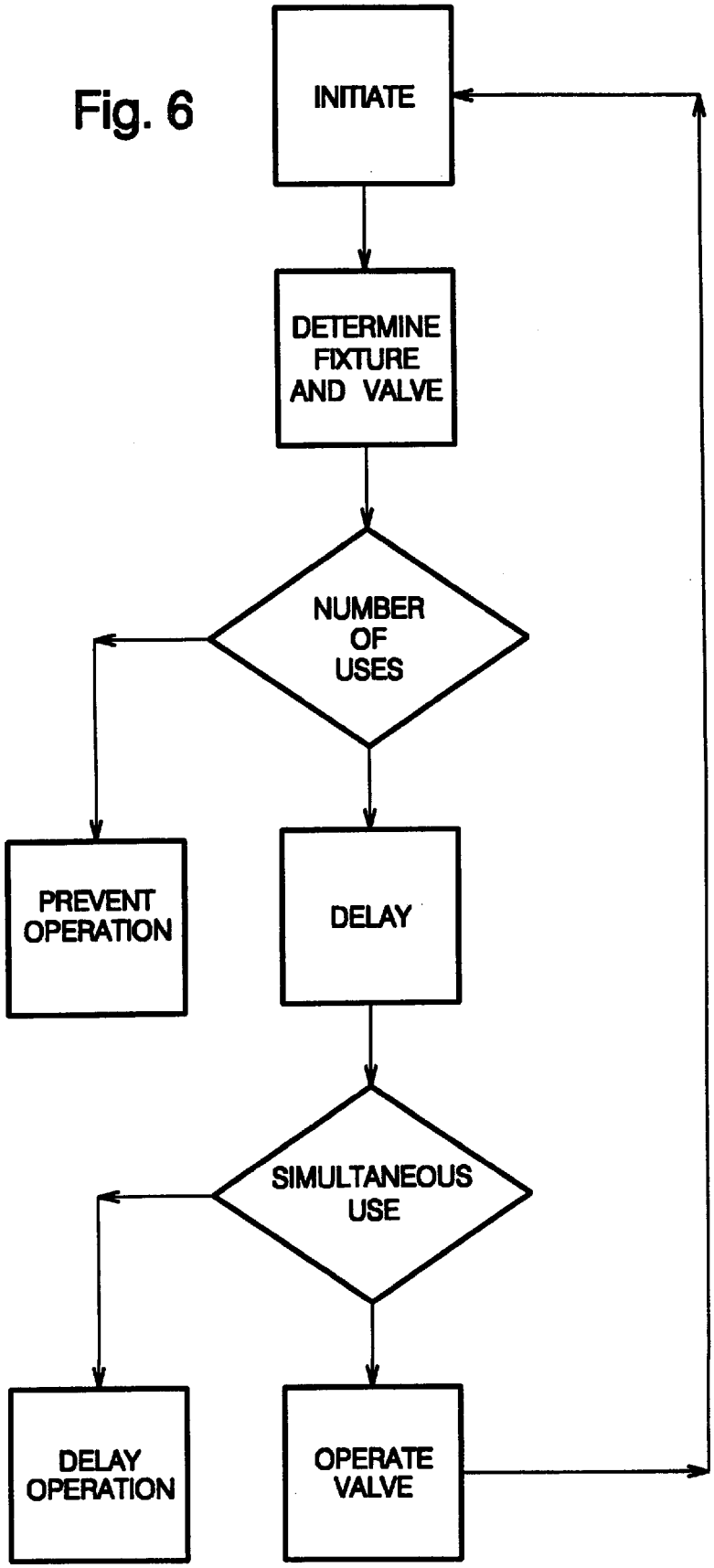
FIG. 6 is a flow diagram illustrating the operation of the invention.

FIG. 6 discloses the algorithm by which the control system, which is preferably a microprocessor, such as sold by Motorola as MC68HC811EZP, contained within the control panel 32, determines whether to permit operation of a control valve 28 subsequent to receipt of a demand signal from the associated sensor 36. The control panel 32 is initiated or made operable and, upon receipt of a demand signal from any one of the sensors 36, determines which fixture F and which valve 28 thereof is requesting operation. The control system then determines whether operation of that valve 28 will exceed a predetermined number of uses per unit time. The predetermined number of uses per unit time prevents an inmate from rapidly and continually flushing the toilet 12, thereby preventing sheets or the like from being flushed down the drain 20, because repeated usage is one indicator of prisoner abuse. Should the requested next use exceed the selected maximum number of uses per unit time, then operation of the valve 28 is prevented. It should be appreciated, however, that the maximum number of uses per unit time is primarily directed to operation of the valves 28 for the toilets 12, because we prefer that the valves 28 for the hot and cold water lines 22 and 24 be operable essentially at all times for sanitation reasons. Also, because a microprocessor is used to operate the algorithm, it is possible to adjust the maximum usage rate based upon time of day, and also between cells and cell blocks as desired.

Should operation of the associated valve 28 not exceed the maximum number of uses permitted per unit time, then the control system causes a delay of a predetermined length. This delay further assures that the inmate will not be able to flush sheets or the like down the drain 20. The delay causes the siphon in the toilet to be interrupted, and it cannot be commenced because the sheet or whatever will block the drain. A sheet or the like cannot be flushed down the drain without maintaining continuity in the siphon. The delay period is based upon established sanitation criteria, and may provide substantial delays between cycles which has heretofore not been possible in conventional prison design. As with the maximum usage rate, because of the microprocessor control, the delay may be adjusted as required. A typical delay would be approximately two minutes between the time the sensor 36 transmits the demand signal to the control panel 32 and initiation of operation of the associated valve 28 by transmittal of the control signal.

Once the delay has elapsed, then the control mechanism determines whether operation of the associated valve 28 would cause too many valves 28 to be operating simultaneously. We have learned that excessive simultaneous use of flush valves, such as the valves 28, can cause tremendous swings in the line pressure of the water line feeding the facility. U.S. Pat. No. 4,914,758 for the invention entitled FRESH WATER CONTROL SYSTEM AND METHOD, the disclosure of which is incorporated herein by reference and the assignee of which is also the assignee hereof, teaches a control system which prevents excessive simultaneous use of water-consuming fixtures. Control of simultaneous use permits smaller water lines to be used, smaller drain lines to be used, and further minimizes the operating and construction cost of the facility.

Assuming that operation of the valve 28 requesting operation will not exceed the permitted simultaneous usage factor, then that valve 28 is permitted to operate. If operation of that valve 28, on the other hand, would cause the system to exceed the available water supply, as noted in said referenced patent, then operation is delayed until sufficient water is available. As noted in that patent, we prefer that sinks, such as the sink 14, always be capable of operation, for sanitation reasons. Also, in order to further reduce waste, the valves 28 for the water lines 22 and 24 are only open for a set period. This applies also the valve 28 of each flush line 18.

The indicator lights 34 on the control panel 32 are used to notify responsible officials that excessive usage of a fixture F is being attempted. In other words, if an inmate is attempting to repeatedly operate the valve 28 of the toilet 12, then this fact is made known so that corrective action can be taken. An indicator light may also be provided to notify when a water line 22 or 24 is continually being operated. For this reason, the control panel 32 can be positioned in a guard's room or the like, or some other area which is continuously monitored. The panel 32 and the valves 28 do not occupy much space, and the panel 32 can, if necessary, be remote from the valves 28.

The control panel 32 furthermore has a master switch 54 which is used to prevent operation of all valves 28. The switch 54 is used, for example, when the corrections officers are about to conduct a search for contraband, and thereby wish to prevent operation of all valves 28 feeding the sinks 14 and toilets 12. This prevents contraband from being washed down the sinks 14 and/or flushed down the toilets 12.

The control panel 32 furthermore has switches 56 which are used to disable the valves 28 feeding an associated one of the cells C. In this way, the corrections officers can conduct a search for contraband in any one of the cells C, while permitting the remaining cells C to continue to be capable of consuming water.

Many existing penal facilities would find it expensive to remove their existing plumbing fixtures in order to install new fixtures incorporating the capacitance sensors which have been earlier described. We have therefore developed a push button which utilizes many of the components of the push buttons in existing prison fixtures, but which incorporates a sensor in order to activate an electromechanically operated valve for supplying water to the fixture. In addition, the disclosed push button is self-calibrating in order to minimize the possibility of inmate abuse, and to prevent it from being continuously positioned in the operate condition.

Figure 7:
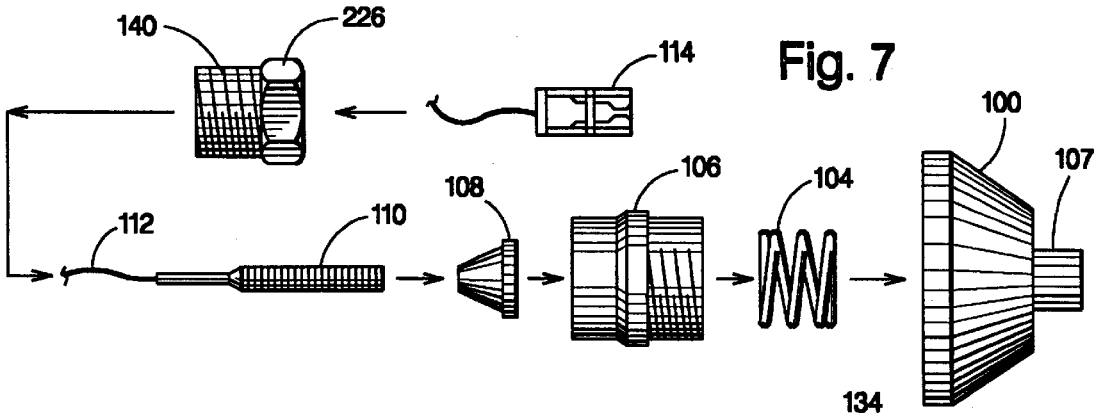
FIG. 7 is an exploded assembly drawing of a self-calibrating push button used with the invention.

Push button assembly P, as best shown in FIG. 7, includes a steel housing 100 which is part of the existing button. A push button plunger 102 has a portion extending forwardly from housing 100 and a further portion contained within the housing. Helical coil spring 104 is positioned within the housing 100 and is maintained therein by bushing 106. Resilient cone 108 is positioned within a portion of bushing 106 and inductive sensor 110 extends through cone 108 and through bushing 106 into housing 100. Sensor 110 has a resilient electrical lead 112 terminating in plug 114. The plug 114 is, preferably, a modular telephone plug. Bushing 116 secures cone 108 within bushing 106.

Figure 8:
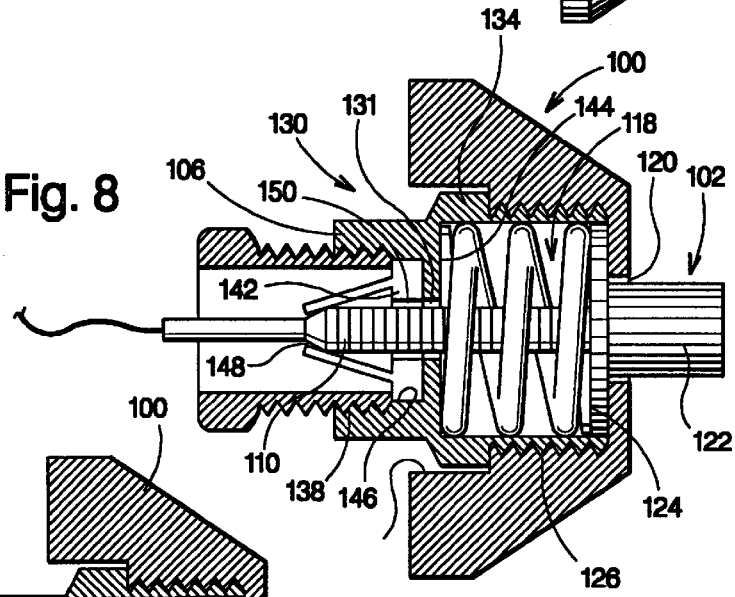
FIG. 8 is a cross-sectional view of the push button of FIG. 7 in its initially installed position.

As best shown in FIG. 8, housing 100 has an interior chamber 118 and an opening 120 through which button 122 extends. Flange 124 is integral with button 122 of push button 102, and is disposed within chamber 118. Chamber 118 has threads 126 around the periphery thereof for engaging corresponding threads 128 of bushing 106.

Housing 100 has an opening 130 permiting the bushing 106 to be introduced therein. Recess 132 is formed in housing 100 in the area of opening 130 in order to receive flange 134 of bushing 106. The flange 134 cooperates with the recess 132 in order to limit the travel of bushing 106 into the housing 100.

Bushing 106 has opening 136 through which sensor 110 extends. The opening 136 is coaxial with openings 120 and 130 when the bushing 106 is inserted into housing 100 for thereby centering the sensor 100 relative to the button 122 and the flange 124. The bushing 106 has threads 138 for engaging corresponding threads 140 on the bushing 116.

Resilient cone 108 is frustoconical in configuration, and the base 142 thereof rests against apetured plate 144 of bushing 106. Recess 146 is formed within bushing 106 for receiving the base 142 of the cone 108, and for therewith positioning the cone 108. The cone 108 has an opening 148 in the frustum thereof for grasping the sensor 110, and for permitting the sensor 110 to move relative thereto.

We prefer that the sensor 110 be an inductive sensor, such as manufactured by Electromatic Controls Corp. under the designation E10801PPOSπL. Those skilled in the art understand that an inductive sensor is one which generates a signal in response to a disturbance within a designated space. Although we prefer the use of an inductive sensor, other sensors, such as magnet reed switches may also be utilized. Whatever sensor is used, the purpose is to sense the approach of the metal push button 102.

Concerning the cone 108, we have found that a rubber cone manufactured by Sloan Valve Company under the designation B-39 works best. It is merely necessary, however, that the cone 108 or like resilient member be appropriately sized to be received within the bushing 106 and to receive and permit sliding of the cylindrical sensor 110. Preferably the opening 150 in the base 142 of cone 108 corresponds substantially to the diameter of the sensor 110 in order to firmly grasp the sensor 110, while allowing the sensor 110 to move relative thereto and relative to the opening 148 in the frustum.

The installation of the push button assembly P must take into account the limited space available for installing the push button P. The push button P may have to be accessed through a chase wall or like close tolerance structure, so the installation must be relatively uncomplicated. Sensors of the type of sensor 110 must usually be calibrated for proper operation, because the manufacturer cannot normally preset the positioning of the components in order to take into account dimensional differences which may occur in installation. For this reason, the push button P has been designed to permit calibration by the plumber or electrician who installs it, while also preventing the push button P from being permanently in the operative condition.

FIG. 8 discloses the push button P as it is initially installed by the plumber. In this orientation, the rearwardmost tapered end 152 of the active portion of the sensor 110 is positioned within the opening 148 of the cone 108. The forward end 154 of the sensor 110 is engaged with the flange 124 of the push button 102.

Figure 9:
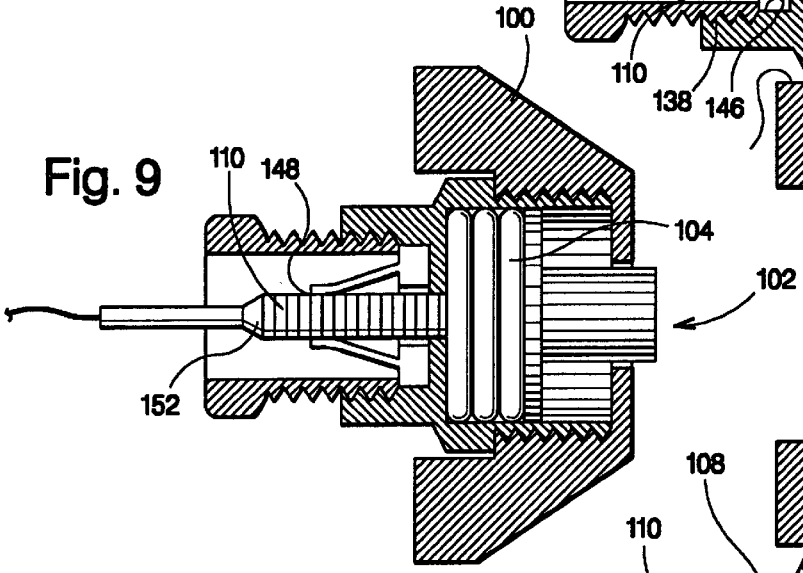
FIG. 9 is a cross-sectional view of the push button of FIG. 7 as it is being calibrated or operated.

FIG. 9 discloses the push button P after the plumber has pressed upon the push button 102, and thereby caused the flange 124 to engage the sensor 110 and move same rearwardly. As can be seen in FIG. 9, the end 152 of the sensor 110 has now been rearwardly moved relative to the opening 148. Because the rubber of the openings 148 and 150 grasps the sensor 110, then the sensor 110 is maintained in the position to which it has been moved on account of movement of the push button 102. The push button 102 must thus hereafter be moved to at least the same position in order to activate the sensor 110.

Figure 10:
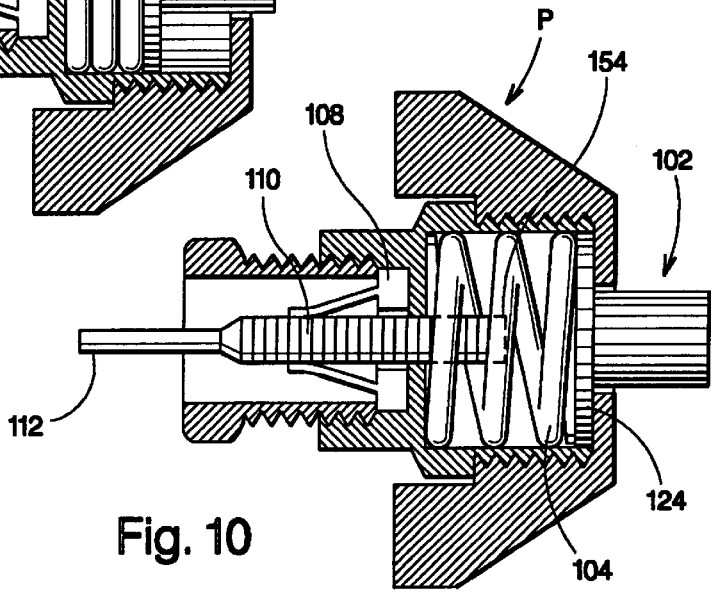
FIG. 10 is a cross-sectional view of the push button of FIG. 9 in the operative condition.

FIG. 10 discloses the push button P in the rest position with the flange 124 spaced from the forward end 154 of the sensor 110. Spring 104 is coaxial with sensor 110 and urges the push button 102 outwardly, so that cylindrical portion 122 extends through opening 120 in order to be accessible to a user. In the position of FIG. 10, the sensor 110 does not engage the flange 124 and therefore a demand signal is not transmitted through lead 112. In the orientation of FIG. 9, on the other hand, because the flange 124 engages the end 154, then a demand signal is sent through lead 112. FIG. 9 thus illustrates the calibrated position of push button P, and also its operative position.

It is not necessary for the plumber to depress the push button 102 as far as is illustrated in FIG. 9. All that it is necessary is that the push button 102 be depressed in order to move the sensor 110 by an amount sufficient to prevent a demand signal from being continuously sent by the sensor 110. Once the sensor 110 has been initially calibrated relative to the flange 124 by movement of the push button 102 in a first direction, then the system is ready for operation because spring 104 urges the button 102 into the opposite direction.

Because of the cone 108, should a user depress the push button 102 by an amount exceeding the distance by which the plumber had pressed the push button 102 during initial calibration, then the sensor 110 will slide a corresponding distance. The new position of the sensor 110 thereby determines the distance by which the push button 102 must thereafter be depressed. Because of the cone 108, then the push button P is self-calibrating because the plumber or user may set the trigger point for causing the demand signal to be transmitted by the sensor 110 through the lead 112.

Figure 11:
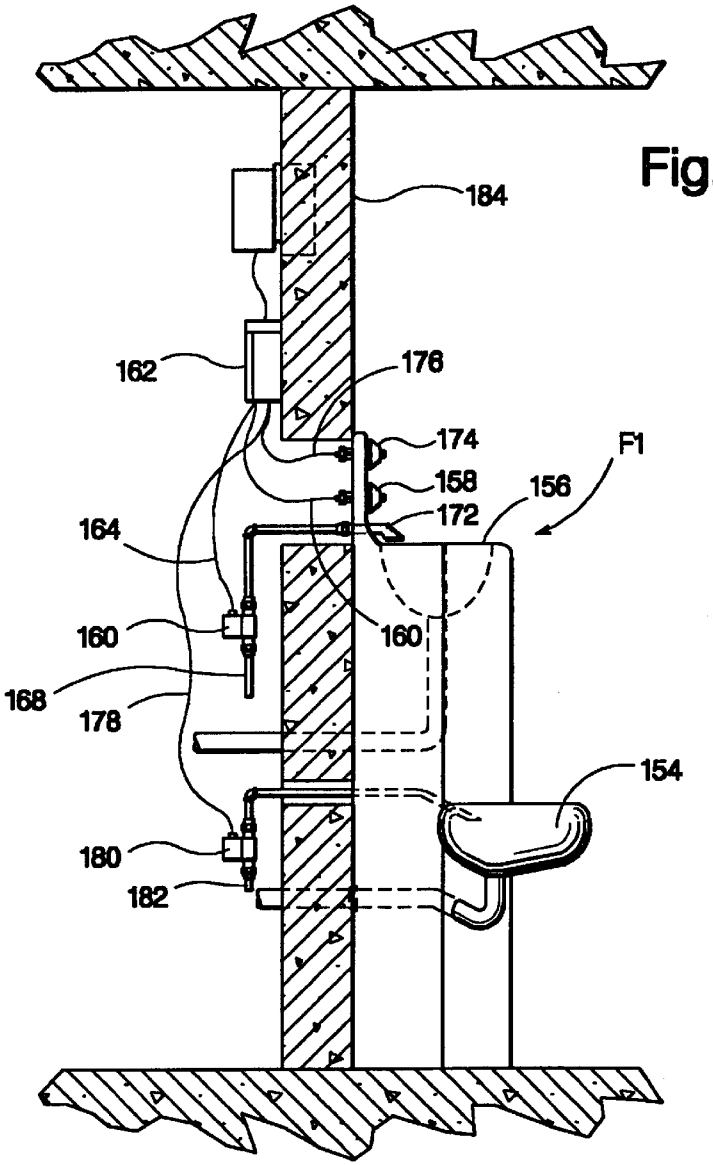
FIG. 11 is an elevational view partially in section of a prison fixture incorporating the push button of FIG. 10.

FIG. 11 discloses a conventional prison toilet/sink fixture F1 comprising a toilet 154 and a sink 156. Push button 158 which corresponds to one of the push button assemblies P is mounted to the fixture F1 and the lead 160 thereof connects with control box 162. Control box 162 has a lead 164 connected with solenoid operated valve 166 in order to cause water to be communicated from supply line 168 through pipe 170 to faucet 172. The valve 166 may be one manufactured by Automatic Switch Company as catalog #MU2568062, 4 watts.

Push button 174, which also corresponds to a push button assembly P, likewise has a lead 176 communicating with control box 162. Control box 162 communicates through lead 178 with solenoid operated valve 180 in order to provide flushing water from line 182 to toilet 154.

The control box 162 incorporates a microprocessor for implementing the algorithm illustrated in FIG. 6 for determining whether the valve 180 should be operated. Although we have shown the control box 162 as being mounted to the chase wall 184 those skilled in the art will understand that the control box 162 need not be so located.

Figure 12:
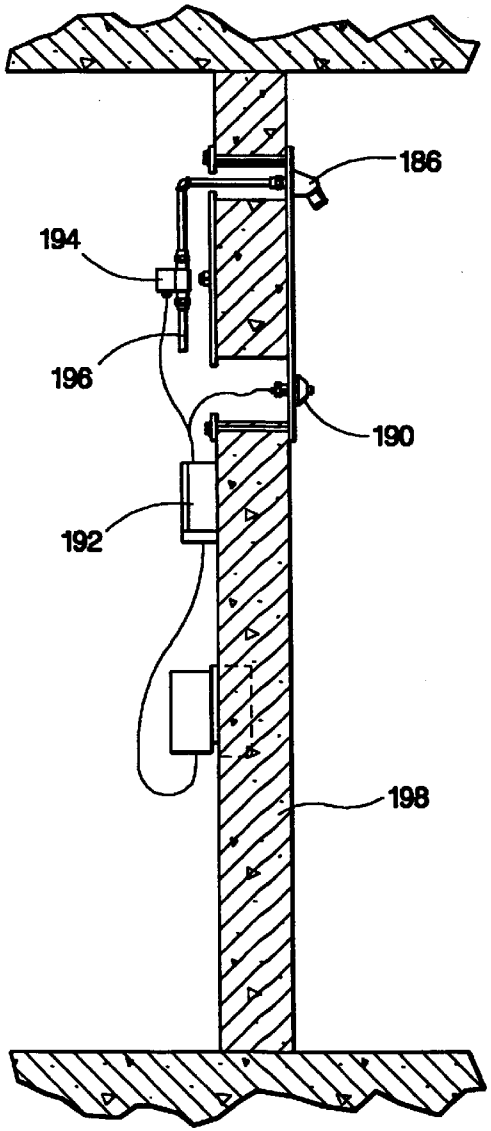
FIG. 12 is an elevational view partially in section of a shower incorporating the push button of FIG. 10.

FIG. 12 illustrates a showerhead 186 mounted to chase wall 188. Push button 190, which corresponds with one of the push button assemblies P, is in electrical connection with control box 192 through electrical leads and plugs as earlier described. Solenoid operated valve 194 is likewise an electrical connection to corresponding means with the control box 192 in order to permit water to flow from line 196 to showerhead 186. The valve 194 may be manufactured by James Hardie Industries Group as Model ·700.75.

While this invention has been described as having a preferred design, it is understood that it is capable of further modifications, uses and/or adaptations of the invention, following in general the principle of the invention, and including such departures therefrom as are customary in the art to which the invention pertains, and as may apply to the claims which are appended hereto.

What we claim is:

1. A controlled plumbing fixture, comprising:

a) a plumbing fixture;

b) electromechanical valve means operably associated with said fixture for regulating water flow thereto;

c) control means operably associated with said valve means for controlling operation thereof; and d) a push button assembly including an axially movable plunger, an axially movable signal supplying element, and means disposed about and slidably engaged with said element for selectively positioning and maintaining said element intermediate axially spaced first and second points, said assembly operably associated with said control means for causing a demand signal to be supplied to said control means for thereby causing said control means to supply a control signal to said valve means for causing operation thereof upon actuating of said element by cooperative movement of said plunger.

2. The fixture of claim 1, wherein:

(a) said fixture is one of a toilet, sink and shower.

3. The fixture of claim 1, wherein:

a) biasing means are operably associated with said plunger for urging said plunger toward the first position; and b) said element is a sensor.

4. The fixture of claim 1, wherein:

(a) said positioning and maintaining means includes an elastomeric member.

5. The fixture of claim 4, wherein:

(a) said member is frustoconical, and the frustum thereof is spaced from said second point.

6. The fixture of claim 3, wherein:

(a) said biasing means includes a coil spring; and (b) said spring surrounds at least a portion of said sensor.

7. The fixture of claim 6, wherein:

(a) said plunger includes a flange engaged with said spring.

8. The fixture of claim 3, wherein:

said sensor is an inductive sensor.

* * * * *